US005525571A

United States Patent [19]

Hosoi

[11] Patent Number: 5,525,571

[45] Date of Patent: Jun. 11, 1996

[54] HEAT-SENSITIVE RECORDING MATERIAL

[75] Inventor: Noriyuki Hosoi, Shizuoka, Japan

[73] Assignee: Fuji Photo Film Co., Ltd., Kanagawa, Japan

[21] Appl. No.: 527,774

[22] Filed: Sep. 13, 1995

[30] Foreign Application Priority Data

Sep. 14, 1994 [JP] Japan ..... 6-219919

[51] Int. Cl.[6] ..... B41M 5/30; B41M 5/40

[52] U.S. Cl. ..... 503/200; 503/201

[58] Field of Search ..... 427/150–152; 503/200, 201

[56] References Cited

FOREIGN PATENT DOCUMENTS 63-265682 11/1988 Japan ..... 503/201

*Primary Examiner*—Bruce Hess

*Attorney, Agent, or Firm*—Sughrue, Mion, Zinn, Macpeak & Seas

[57] ABSTRACT

A heat-sensitive recording material comprising a substantially transparent support and a heat-sensitive recording layer formed on one side thereof, wherein the thermal recording energy required for increasing the transmission density of recorded areas as measured with a Macbeth transmission densitometer TD904 (visual filter) to a value higher by 0.1 than the transmission density of non-recorded areas is from 10 mJ/mm$^2$ to 40 mJ/mm$^2$, and the energy required for obtaining a transmission density of 2.5 in recorded areas as measured with a Macbeth transmission densitometer TD904 (visual filter) is from 80 mJ/mm$^2$ to 130 mJ/mm$^2$. The recording material provides a highly precise gradated image using a conventional thermal head.

3 Claims, No Drawings

HEAT-SENSITIVE RECORDING MATERIAL

FIELD OF THE INVENTION

The present invention relates to a heat-sensitive recording material. More particularly, the present invention relates to a heat-sensitive recording material which provides high image quality in a stable manner, especially when recording is conducted with a thermal head and the recorded images are observed with transmitted light.

BACKGROUND OF THE INVENTION

The use of thermal recording is expanding in the fields of facsimile telegraphs and printers, labels including POS, etc. This is because thermal recording has the following advantages: (1) development is unnecessary, (2) the quality of paper supports for thermal recording is similar to that of general paper, (3) handling is easy, (4) developed-color densities are high, (5) the recording apparatus is simple and inexpensive, and (6) the recording operation is quiet. Because of the increasing number of applications, the performance requirements of heat-sensitive recording materials have become diverse. A heat-sensitive recording material capable of multicolor recording and a transparent heat-sensitive recording material for overhead projectors have been developed as described, for example, in JP-A-63-265682. (The term "JP-A" as used herein means an "unexamined published Japanese patent application.")

With the recent trend toward the use of electronic medical equipment such as ultrasonic scanners, CT scanners, and X-ray apparatus, a transparent heat-sensitive recording material has also been developed for directly recording images from digital signals that are received from this type of equipment.

However, conventional heat-sensitive recording materials comprising a transparent support and a heat-sensitive recording layer formed thereon are disadvantageous in that image density unevenness in thermal-head recording caused by, e.g., fluctuation in thermal-head resistivity, surface roughness of a glazing layer, and fluctuation in the moving speed of the thermal head or recording material, tends to be more noticeable. This is because the recorded images are observed with transmitted light. A second disadvantage is that conventional heat-sensitive recording materials are subject to density fluctuations with changes in temperature and humidity. Density fluctuations are troublesome in those applications where high image precision is required such as in medical images.

SUMMARY OF THE INVENTION

Accordingly, an object of the present invention is to provide a heat-sensitive recording material which is capable of providing highly precise gradated images, such as medical images, in a stable manner using a conventional thermal head.

The above object of the present invention is achieved by providing a heat-sensitive recording material comprising a substantially transparent support and a heat-sensitive recording layer formed on one side of the support, said recording material being adapted for thermal recording comprising imagewise applying thermal energy to the recording layer to obtain recorded and non-recorded areas of the recording material, wherein the thermal recording energy required for increasing the transmission density of recorded areas as measured with a Macbeth transmission densitometer TD904 (visual filter) to a value higher by 0.1 than the transmission density of non-recorded areas is from 10 mJ/mm$^2$ to 40 mJ/mm$^2$, and the thermal recording energy required for obtaining a transmission density of 2.5 in recorded areas as measured with a Macbeth transmission densitometer TD904 (visual filter) is from 80 mJ/mm$^2$ to 130 mJ/mm$^2$.

DETAILED DESCRIPTION OF THE INVENTION

In the recording material of the present invention, if the energy required for increasing the transmission density as measured with a Macbeth transmission densitometer TD904 (visual filter) to a value higher by 0.1 than the transmission density of non-recorded areas is below 10 mJ/mm$^2$, the background becomes considerably colored during storage. On the other hand, if that energy exceeds 40 mJ/mm$^2$, not only do density fluctuations with a change in environmental conditions become larger, but also severe unevenness results. The energy required for increasing the transmission density to a value higher by 0.1 than the transmission density of non-recorded areas is preferably from 20 mJ/mm$^2$ to 30 mJ/mm$^2$. Furthermore, if the energy required for obtaining a transmission density of 2.5 as measured with a Macbeth transmission densitometer TD904 (visual filter) is below 80 mJ/mm$^2$, not only do density fluctuations with a change in environmental conditions become larger, but severe unevenness results. If the energy required for a transmission density of 2.5 exceeds 130 mJ/mm$^2$, the support becomes deformed. The energy required for obtaining a transmission density of 2.5 is preferably from 90 mJ/mm$^2$ to 110 mJ/mm$^2$.

The substantially transparent support of the present invention is a polymer resin film having a haze value represented by the equation $$\text{Haze value (\%)} = \frac{\text{diffuse transmittance}}{\text{total light transmittance}} \times 100$$

of 40% or lower. The support is preferably a polymer resin film having a haze of 20% or lower, more preferably 10% or lower.

In the present invention, the support is not particularly limited as long as it is substantially transparent. The support preferably comprises a transparent polymer resin which has been colored so as to have a color within the quadrilateral region defined by the four points of A (x=0.2805, y=0.3005), B (x=0.2820, y=0.2970), C (x=0.2885, y=0.3015), and D (x=0.2870, y=0.3040) in the chromaticity coordinate system described in JIS-Z8701. Examples of methods for coloring a transparent polymer resin include a method in which a material for forming a transparent sheet, made of, e.g., poly(ethylene terephthalate), poly(butylene terephthalate), cellulose triacetate, polypropylene, polystyrene, polyethylene, poly(vinylidene chloride), polyacrylic, or polycarbonate, is kneaded with a blue dye before the material is formed into a resin film; and a method in which a blue dye is dissolved in an appropriate solvent to prepare a coating liquid, which coating liquid is applied to a transparent and colorless resin film by a known coating technique, e.g., gravure coating, roller coating, or wire coating, and then dried. Preferred of such supports is a film produced by incorporating a blue dye into a polyester resin such as poly(ethylene terephthalate) or poly(ethylene naphthalate) by kneading, forming the dyed resin into a film, and subjecting this film to thermal treatment, stretching, and antistatic treatment.

Dyes for use in coloring the support are not particularly limited. However, dyes for use in blue or violaceous film bases for X-ray photographs are generally preferred. Examples of such dyes include the dyes described in JP-B-47-8734, JP-B-47-30294, and JP-B-51-25335. (The term "JP-B" as used herein means an "examined Japanese patent publication.") Dyes may be used alone or in admixture. Specific examples of such blue or violaceous dyes include the compounds represented by the following structural formulae.

(a)

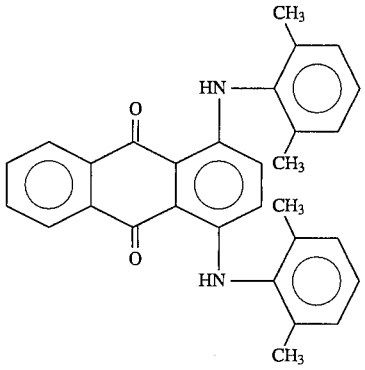

(b)

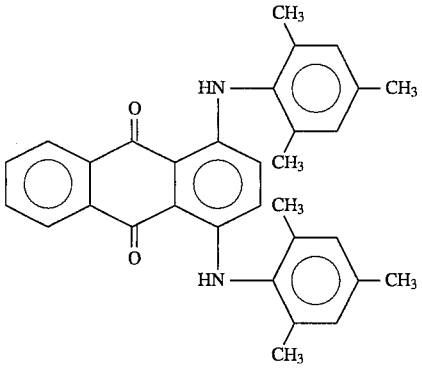

(c)

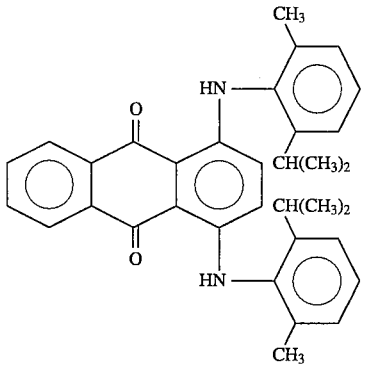

(d)

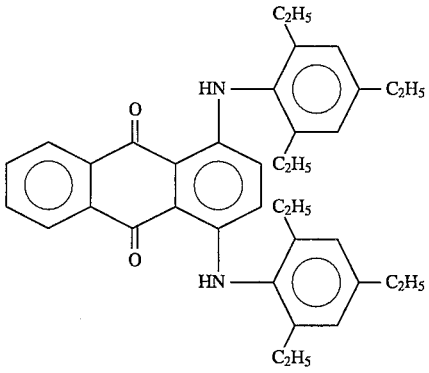

-continued (e)

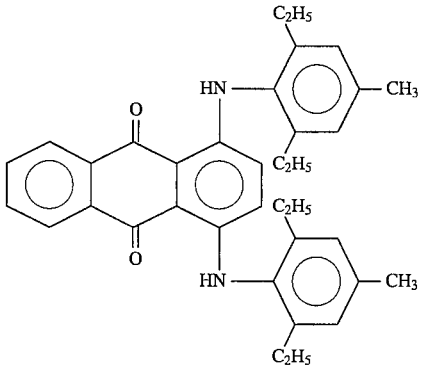

(f)

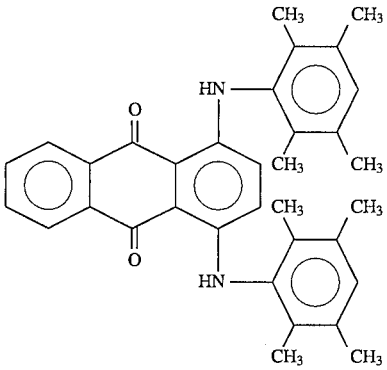

(g)

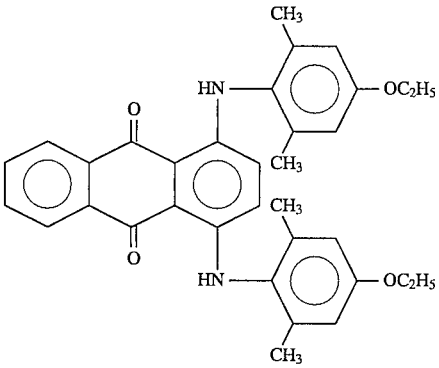

(h)

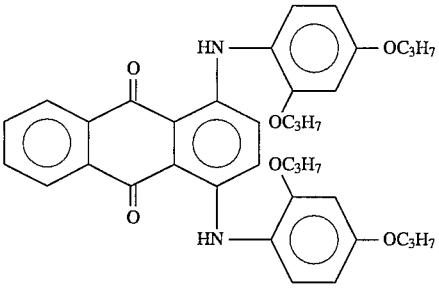

-continued (i)

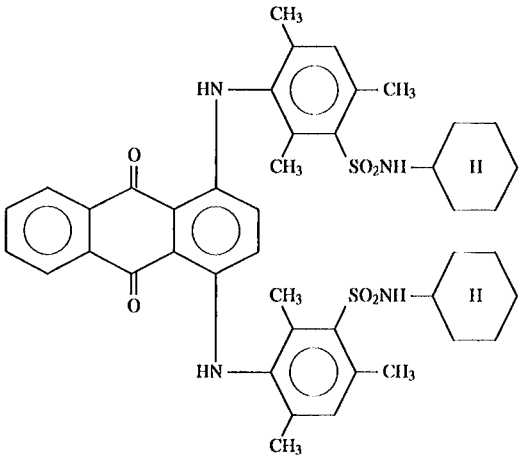

(j)

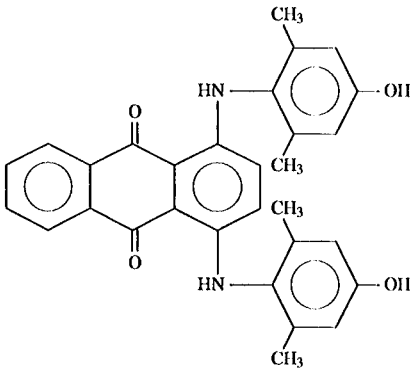

(k)

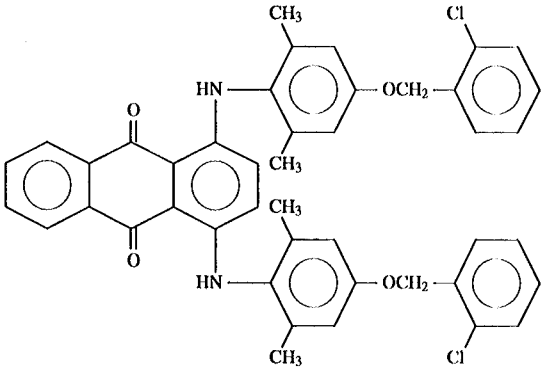

(l)

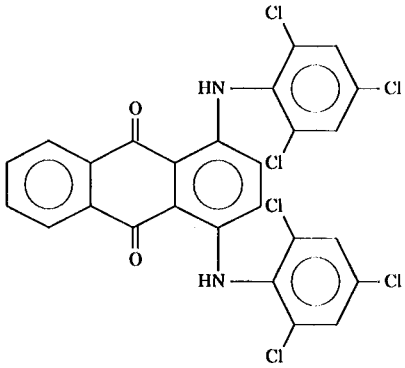

-continued (m)

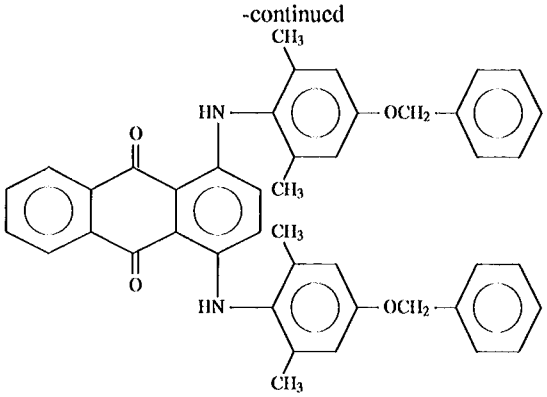

(n)

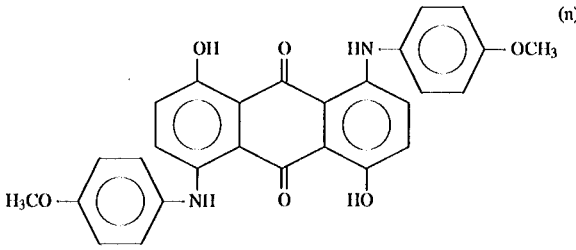

(o)

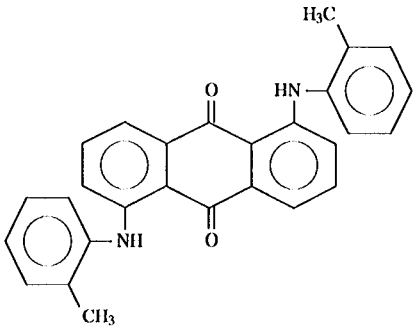

(p)

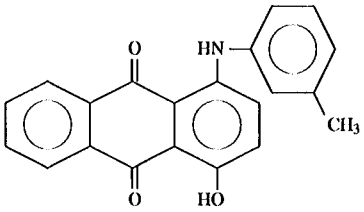

(q)

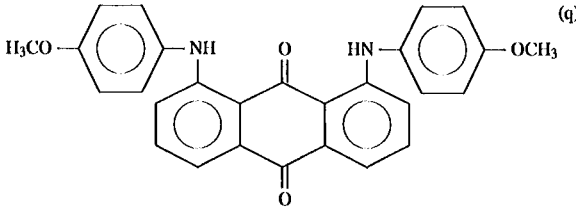

The support for use in the present invention is preferably dyed in a color within the quadrilateral region defined by the four points of A (x=0.2805, y=0.3005), B (x=0.2820, y=0.2970), C (x=0.2885, y=0.3015), and D (x=0.2870, y=0.3040) in the chromaticity coordinate system described in JIS-Z8701. This is accomplished by changing the kinds and amounts of dyes for use in the coloring. If the color of the dyed support is above the straight line A-D in the chromaticity coordinate system with x as abscissa and y as ordinate, the color undesirably is greenish blue. If the color of the dyed support is below the straight line B-C, red is undesirably enhanced. Furthermore, if the color of the dyed support is on the right of the straight line D-C, yellow is enhanced, which is undesirable especially when observing images formed in highlight parts.

The thickness of the support is not particularly limited, but the preferred range thereof is generally from 25 to 200 μm.

In the present invention, the thermal energy applied to the heat-sensitive recording material with a thermal head is defined by the following equation.

Energy=[energy (V) applied per dot of the thermal head/resistivity (Ω) per dot]$^2$×pulse width (msec)÷(recording area (mm$^2$) per dot per pulse)

An anti-reflection layer may be formed on the recording material of the present invention to reduce the gloss of the side opposite the heat-sensitive recording layer to 50% or lower, especially preferably 30% or lower, measured at an incident light angle of 20°. The glossiness of the support on the side of the anti-reflection layer is measured using a specular glossmeter as glossiness to a glass surface at an incident angle of 20°, according to "Method 5" (specular gloss at an incident angle of 20°, Gs(20°)) as described in JIS-Z8741, 349–353 (1983). The anti-reflection layer contains a polymeric binder and a fine particulate substance. Examples of the polymeric binder include methyl cellulose, carboxymethyl cellulose, hydroxyethyl cellulose, starches, gelatin, modified gelatins, poly(vinyl alcohol), carboxylated poly(vinyl alcohol), polyacrylamide, polystyrene and styrene copolymers, polyesters and ester copolymers, polyethylene and ethylene copolymers, epoxy resins, acrylate or methacrylate resins and acrylate or methacrylate copolymers, polyurethane resins, and polyamide resins.

In order to prevent reflection from the support of light having wavelengths which make images blurry, to thereby obtain distinct images having reduced gloss, a suitable fine particulate substance is selected so as to provide a gloss of 50% or lower, especially preferably 30% or lower, as measured at an incident light angle of 20°. Fine particulate substances having a particle diameter of from 1 to 20 μm, in particular from 1 to 10 μm, are especially preferred because such particulate substances can be used for regulating gloss without deteriorating image quality.

Examples of the fine particulate substance include fine particles of starch obtained from barley, wheat, corn, rice, and beans; fine particles of synthetic polymers such as cellulose fibers, polystyrene resins, epoxy resins, polyurethane resins, urea-formalin resins, poly(meth)acrylate resins, poly(methyl (meth)acrylate) resins, vinyl chloride/vinyl acetate copolymer resins, and polyolefins; and fine particles of inorganic substances such as calcium carbonate, titanium oxide, kaolin, smectite clay, aluminum hydroxide, silica, and zinc oxide. These fine particulate substances may be used in combination of two or more thereof. To obtain a heat-sensitive recording material having good transparency, fine particulate substances having a refractive index of from 1.45 to 1.75 are preferred.

The finely particulate substance is used in an amount of from 0.5 to 10% by weight, preferably from 1 to 5% by weight, based on the amount of the polymeric binder contained in the anti-reflection layer. Amounts of the particulate substance smaller than 0.5% by weight are undesirable in that the anti-reflective effect is insufficient, while amounts thereof exceeding 10% by weight are undesirable in that unclear images result, although gloss is reduced.

The heat-sensitive recording material of the present invention may optionally have a ultraviolet filter layer for preventing from color fading due to light. The ultraviolet filter layer contains an ultraviolet absorber in the form of dispersions, emulsions, or microcapsules in an amount of generally from 0.1 to 5 g/m$^2$, preferably from 0.5 to 2.0 g/m$^2$. The ultraviolet absorber for use in the present invention is not particularly limited. However, preferred examples of the ultraviolet absorber include benzotriazole type absorbers and benzophenone type absorbers. Details of the ultraviolet filter layer are described, for example, in JP-B-53-23205. The ultraviolet filter layer may be provided on the side of the support opposite the heat-sensitive recording layer, between the support and the heat-sensitive recording layer, or on the heat-sensitive recording layer.

In the present invention, an image is recorded by the reaction of a color former with a developer, which components are kept apart from each other at ordinary storage temperatures (generally from 0° to 35° C.). Upon heating, the color former and the developer come into contact with each other to develop a color.

The color former and the developer each is substantially colorless before color development. Upon contact with each other, the two ingredients undergo a color developing reaction. Examples of combinations of the two ingredients include the following (a) to (m).

(a) Combinations of a photo-decomposable diazo compound and a coupler.

(b) Combinations of an electron-donating dye precursor and an electron-accepting compound.

(c) Combinations of an organic metal salt such as silver behenate or silver stearate and a reducing agent such as protocatechuic acid, spiroindane, or hydroquinone.

(d) Combinations of a long-chain fatty acid salt such as ferric stearate or ferric myristate and a phenol derivative such as gallic acid or ammonium salicylate.

(e) Combinations of a salt of an organic acid such as acetic acid, stearic acid, or palmitic acid with a heavy metal such as nickel, cobalt, lead, copper, iron, mercury, or silver and a sulfide of an alkaline earth metal such as calcium sulfide, strontium sulfide, or potassium sulfide; or combinations of such a heavy metal salt of an organic acid and an organic chelating agent such as s-diphenylcarbazide or diphenylcarbazone.

(f) Combinations of a (heavy) metal sulfate such as silver sulfide, lead sulfide, mercury sulfide, or sodium sulfide and a sulfur compound such as Na-tetrathionate, sodium thiosulfate, or thiourea.

(g) Combinations of a ferric salt of a fatty acid such as ferric stearate and an aromatic polyhydroxy compound such as 3,4-dihydroxytetraphenylmethane.

(h) Combinations of a noble metal salt of an organic acid such as silver oxalate or mercury oxalate and an organic polyhydroxy compound such as a polyhydroxy alcohol, glycerol, or a glycol.

(i) Combinations of a ferric salt of a fatty acid such as ferric pelargonate or ferric laurate and either thiocetylcarbamide or an isothiocetylcarbamide derivative.

(j) Combinations of a lead salt of an organic acid such as lead caproate, lead pelargonate, or lead behenate and a thiourea derivative such as ethylenethiourea or N-dodecylthiourea.

(k) Combinations of a heavy metal salt of a higher fatty acid such as ferric stearate or copper stearate and a zinc dialkyldithiocarbamate.

(l) Combinations which form an oxazine dye, such as combinations of resorcinol and a nitroso compound.

(m) Combinations of a formazan compound and a reducing agent and/or a metal salt.

Preferred of these in the present invention are combinations (a), i.e., combinations of a photo-decomposable diazo compound and a coupler, combinations (b), i.e., combinations of an electron-donating dye precursor and an electron-accepting compound, and combinations (c), i.e., combinations of an organic metal salt and a reducing agent, with combinations (a) and combinations (b) being especially preferred. Namely, the use a combination of an electron-donating dye precursor (color former) and an acid substance (developer) or a combination of a diazo compound (color former) and a coupling compound (developer) is preferred. Especially from the standpoint of image clearness, the former combination is preferably employed.

The electron-donating colorless dye for use in the present invention is not particularly limited, as long as it is a substantially colorless substance. However, the electron-donating dye is preferably a substantially colorless compound which has the property of developing a color upon donation of an electron or upon reception of a proton from an acid, etc., and which has a lactone, lactam, sultone, spiropiran, ester, or amide skeleton or a similar skeleton and undergoes ring opening or cleavage at this skeleton upon contact with a developer. Examples of the color former include various compounds such as triphenylmethanephthalide compounds, fluoran compounds, phenothiazine compounds, indolylphthalide compounds, leuco auramine compounds, rhodamine lactam compounds, triphenylmethane compounds, triazene compounds, spiropyran compounds, and fluorene compounds. Specific examples of the phthalide compounds are described in U.S. Reissued Patent U.S. Pat. No. 23,024 and U.S. Pat. Nos. 3,491,111, 3,491,112, 3,491,116, and 3,509,174. Specific examples of the fluoran compounds are described in U.S. Pat. Nos. 3,624,107, 3,627,787, 3,641,011, 3,462,828, 3,681,390, 3,920,510, and 3,959,571. Specific examples of spirodipyran compounds are described in U.S. Pat. No. 3,971,808. Specific examples of pyridine compounds and pyrazine compounds are described in U.S. Pat. Nos. 3,775,424, 3,853,869, and 4,246,318. Specific examples of the fluorene compounds are described in JP-A-63-94878.

Particularly effective of these color formers are black-developing 2-arylamino-3-(H, halogen, alkyl, or alkoxy)-6-(substituted amino)fluorans. Specific examples thereof include 2-anilino-3-methyl-6-diethylaminofluoran, 2-anilino-3-methyl-6-N-cyclohexyl-N-methylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-anilino-3-methyl-6-N-ethyl-N-isoamylaminofluoran, 2-anilino-3-methyl-6-N-ethyl-N-dodecylaminofluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-o-toluidino-3-methyl-6-diisopropylaminofluoran, 2-anilino-3-methyl-6-N-isobutyl-N-ethylaminofluoran, 2-anilino-3-methyl-6-N-ethyl-N-tetrahydrofurfurylaminofluoran, 2-anilino-3-chloro-6-N-ethyl-N-isoamylaminofluoran, 2-anilino-3-methyl-6-N-methyl-N-γ-ethoxypropylaminofluoran, 2-anilino-3-methyl-6-N-ethyl-N-γ-ethoxypropylaminofluoran, and 2-anilino-3-methyl-6-N-ethyl-N-γ-propoxypropylaminofluoran.

The developer for use in combination with these color formers may be a phenol compound or an acid substance such as an organic acid or a metal salt thereof or a hydroxybenzoic acid ester. Examples of such compounds are described, e.g., in JP-A-61-291183. Specific examples of the developer include bisphenols and analogues thereof such as 2,2-bis(4'-hydroxyphenyl)propane (generally known as bisphenol A), 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-methylpentane, 1,1-bis(4'-hydroxyphenyl)-2-ethylhexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl) sulfone, bis(3-allyl-4-hydroxyphenyl) sulfone, and benzyl bis(p-hydroxyphenyl)acetate; salicylic acid derivatives such as 3,5-di-α-methylbenzylsalicylic acid, 3,5-di-t-butylsalicylic acid, 3-α,α-dimethylbenzylsalicylic acid, and 4-(β-p-methoxyphenoxyethoxy)salicylic acid and salts of these acids with a polyvalent metal (especially preferably zinc or aluminum); hydroxybenzoic acid esters and analogues thereof such as benzyl p-hydroxybenzoate, 2-ethylhexyl p-hydroxybenzoate, and 2-phenoxyethyl β-resorcylate; and phenols and analogues thereof such as p-phenylphenol, 3,5-diphenylphenol, cumylphenol, 4-hydroxy-4'-isopropoxydiphenyl sulfone, and 4-hydroxy-4'-phenoxydiphenyl sulfone. Of these compounds, the bisphenols and analogues thereof are preferred for improving color-developing properties. The addition amount of the developer is preferably from 50 to 800% by weight, more preferably from 100 to 500% by weight, based on the amount of the color former. The electron-accepting compounds described above may be used in a combination of two or more thereof.

The diazo compound for use in the present invention is a photo-decomposable diazo compound which produces a desired hue upon reaction with a developer called a coupling ingredient (described below). Upon exposure to light having a specific wavelength prior to contact with the coupling ingredient, the diazo compound decomposes so that it does not produce a color even upon contact with the coupling ingredient. The hue obtained with this color-developing system is determined by the diazo dye formed by the reaction of the diazo compound with the coupling ingredient. It is therefore possible to easily obtain various developed colors by changing the chemical structure of the diazo compound or of the coupling ingredient, as is well known. Most colors can be developed depending on the combination of the two ingredients.

The photo-decomposable diazo compound for use in the present invention typically is an aromatic diazo compound. More particularly, the photo-decomposable diazo compound includes aromatic diazonium salt, a diazo sulfonate compound, or a diazo amino compound. The diazonium salt is a compound represented by the general formula $ArN_2^+X^-$ (wherein Ar represents a substituted or unsubstituted aromatic moiety, $N_2^+$ represents a diazonium group, and $X^-$ represents an acid anion). A large number of diazo sulfonate compounds are known, which are obtained by treating the corresponding diazonium salts with a sulfite. The diazo amino compound is obtained by coupling a diazo group with dicyandiamide, sarcosine, methyltaurine, N-ethylanthranilic acid-5-sulfonic acid, monoethanolamine, diethanolamine, guanidine, or the like. Details of these diazo compounds are described, e.g., in JP-A-2-136286.

Examples of the coupling ingredient for coupling with the diazo compound in this invention include 2-hydroxy-3-naphthoic acid anilide and the coupling compounds described in JP-A-62-146678 including resorcinol.

In the case where a combination of a diazo compound and a coupling ingredient is used in this invention, a basic substance may be added in order to accelerate the coupling reaction. This basic substance may be a water-insoluble or slightly water-soluble basic substance or a substance which generates an alkali upon heating. Examples of these substances include nitrogen-containing compounds such as inorganic and organic ammonium salts, organic amines, amides, urea and thiourea and derivatives thereof, thiazole, pyrrole, pyrimidine, piperazine, guanidine, indole, imidazole, imidazoline, triazole, morpholine, piperidine, amidines, formamidine, pyridine, and the like and derivatives of such nitrogen-containing compounds. Specific examples of these compounds are described, e.g., in JP-A-61-291183. These basic compounds may be used in a combination of two or more thereof.

The color former or developer for use in the present invention may be incorporated into the heat-sensitive recording layer in the form of solid dispersions by a known method. However, it is preferable to encapsulate the ingredient to improve the transparency of the heat-sensitive recording layer and to attain good shelf stability (antifogging) by preventing the color former and the developer from coming into contact with each other at ordinary temperatures, and also to control the sensitivity for color development, i.e., developing a color with a desired heat energy.

When the color former or developer is used in the form of solid dispersions, the smaller the particle diameter of the solid dispersions is, the lower energy required for developing a color is. Therefore, in the present invention, the use of the combination of rather small-size dispersions having a 50% volume average particle diameter of from 0.1 to 0.6 μm (measured with a laser diffraction particle size distribution analyzer, LA-500; manufactured by Horiba Ltd.) and rather large-size dispersions having a 50% volume average particle diameter of from 0.6 to 2.0 μm in admixture is preferable for developing a color with a desired heat energy. The mixing ratio of the small dispersions to the large dispersions is generally from 1:10 to 10:1.

When the color former or developer is used in the form of microcapsules, a color develops with low energy in the case of that the particle diameter of microcapsules is small, the glass transition temperature of a material of a microcapsule wall is low, or the thickness of a microcapsule wall is thin. On the other hand, a color develops with high energy in the case of that the particle diameter of microcapsules is large, the glass transition temperature of a material of a microcapsule wall is high, or the thickness of a microcapsule wall is thick. Therefore, microcapsules which develop a color with low energy and microcapsules which develop a color with high energy are preferably used in combination for developing a color with a desired heat energy. The microcapsules which develop with low energy preferably have a particle diameter of from 0.1 to 2 μm, and the wall of the microcapsules preferably has a thickness of from 0.005 to 0.1 μm and comprises a material having a glass transition temperature of from 60° to 110° C. The microcapsules which develop with high energy preferably have a particle diameter of from 0.1 to 2 μm, and the wall of the microcapsules preferably has a thickness of from 0.001 to 0.2 μm and comprises a material having a glass transition temperrature of from 110° to 170° C. The mixing ratio of the former to the latter is generally from 1:10 to 10:1.

For producing microcapsules for use in the present invention, any of an interfacial polymerization method, internal polymerization method, and external polymerization method can be employed. Especially preferred is an interfacial polymerization technique in which a core-forming substance containing an electron-donating colorless dye, a diazonium salt, etc. is emulsified into an aqueous solution containing a water-soluble compound dissolved therein, and a wall of a polymeric substance is then formed on the entire surface of each resulting oil droplet.

The reactants for forming the polymer are added to the inside and/or the outside of the oil droplets. Examples of the polymeric substance include polyurethanes, polyureas, polyamides, polyesters, polycarbonates, urea-formaldehyde resins, melamine resins, polystyrene, styrene-methacrylate copolymers, and styrene-acrylate copolymers. Preferred polymeric substances are polyurethanes, polyureas, polyamides, polyesters, and polycarbonates, with polyurethanes and polyureas being especially preferred. These polymeric substances may be used in combination of two or more thereof. Examples of the water-soluble polymer include gelatin, polyvinylpyrrolidone, and poly(vinyl alcohol).

For example, in the case of using a polyurea as a capsule wall material, microcapsule walls can be easily formed by reacting a polyisocyanate, e.g., a diisocyanate, a triisocyanate, a tetraisocyanate, or a polyisocyanate prepolymer, with a polyamine, e.g., a diamine, a triamine, or a tetramine, a prepolymer having two or more amino groups, piperazine or a derivative thereof, a polyol, or the like in an aqueous medium by interfacial polymerization.

Furthermore, capsule walls made of, for example, a polyurea/polyamide composite material or a polyurethane/polyamide composite material can be produced, for example, from a polyisocyanate and an acid chloride or from a polyamine and a polyol by regulating the pH of the dispersion medium as a reaction medium and then heating the system. Details of a process for producing capsule walls made of a polyurea/polyamide composite material are described in JP-A-58-66948.

For controlling the energy required for color development, a mixture of microcapsules of two or more kinds having capsule walls having different glass transition temperatures may be employed in the present invention if desired.

For forming microcapsule walls for use in the present invention which become substance-permeable at lower temperatures, a plasticizer which is solid at ordinary temperatures and preferably has a melting point of 50° C. or higher, but preferably not higher than 120° C., may be selected from plasticizers suitable for polymers for use as a microcapsule wall material. For example, in the case of a polyurea or polyurethane wall material, preferred plasticizers include hydroxy compounds, carbamic esters, aromatic alkoxy compounds, organic sulfonamide compounds, aliphatic amide compounds, and arylamide compounds.

For imparting satisfactory storage stability to the recording material, it is preferred to microencapsulate the color former and to incorporate the developer in the form of an emulsion.

In the present invention, the developer may also be used in the form of dispersed solid particles. However, for improving the transparency of the heat-sensitive recording layer to impart satisfactory light transmission to the heat-sensitive recording material, it is especially preferred to use the developer in the form of an emulsified dispersion. The dispersion may be obtained by dissolving the developer into a slightly water-soluble or water-insoluble organic solvent, and mixing the solution with an aqueous phase containing a water-soluble polymer having a surfactant as a protective colloid to emulsify the solution.

The organic solvent for use in the emulsification may be suitably selected from high-boiling oils. Preferred oils include esters, dimethylnaphthalene, diethylnaphthalene, diisopropylnaphthalene, dimethylbiphenyl, diisopropylbiphenyl, diisobutylbiphenyl, 1-methyl-1-dimethyphenyl-2-phenylmethane, 1-ethyl-1-dimethylphenyl-1-phenylmethane, 1-propyl-1-dimethylphenyl-1-phenylmethane, triallylmethanes (e.g., tritolylmethane and tolyldiphenylmethane), terphenyl compounds (e.g., terphenyl), alkyl compounds, alkylated diphenyl ethers (e.g., propyldiphenyl ether), hydrogenated terphenyls (e.g., hexahydroterphenyl), and diphenyl ether. Of these organic solvents, esters are especially preferably used to impart stability to the emulsion state.

Examples of the esters include phosphoric esters (e.g., triphenyl phosphate, tricresyl phosphate, butyl phosphate, octyl phosphate, and cresyl phenyl phosphate), phthalic esters (e.g., dibutyl phthalate, 2-ethylhexyl phthalate, ethyl phthalate, octyl phthalate, and butyl benzyl phthalate), dioctyl tetrahydrophthalate, benzoic esters (e.g., ethyl benzoate, propyl benzoate, butyl benzoate, isopentyl benzoate, and benzyl benzoate), abietic esters (e.g., ethyl abietate and benzyl abietate), dioctyl adipate, isodecyl succinate, dioctyl azelate, oxalic esters (e.g., dibutyl oxalate and dipentyl oxalate), diethyl malonate, maleic esters (e.g., dimethyl maleate, diethyl maleate, and dibutyl maleate), tributyl citrate, sorbic esters (e.g., methyl sorbate, ethyl sorbate, and butyl sorbate), sebacic esters (e.g., dibutyl sebacate and dioctyl sebacate), ethylene glycol esters (e.g., mono- and diesters with formic acid, mono- and diesters with butyric acid, mono- and diesters with lauric acid, mono- and diesters with palmitic acid, mono- and diesters with stearic acid, and mono- and diesters with oleic acid), triacetin, diethyl carbonate, diphenyl carbonate, ethylene carbonate, propylene carbonate, and boric esters (e.g., tributyl borate and tripentyl borate). Of these esters, tricresyl phosphate alone or in combination with other esters is especially preferred for best emulsion stability. The above described oils may be used in combination with each other or with other oil(s).

An auxiliary solvent as a low-boiling dissolution aid may be added to the above-described organic solvent in the present invention. Especially preferred examples of the auxiliary solvent include ethyl acetate, isopropyl acetate, butyl acetate, and methylene chloride.

The water-soluble polymer incorporated as a protective colloid into the aqueous phase, which aqueous phase is mixed with an oil phase comprising the above described ingredients, suitably selected from known anionic, nonionic, and ampholytic polymers. However, poly(vinyl alcohol), gelatin, and cellulose derivatives are especially preferred.

The surfactant incorporated into the aqueous phase is a surfactant which does not cause the protective colloid to precipitate or flocculate, and is suitably selected from anionic and nonionic surfactants. Preferred examples of the surfactant include sodium alkylbenzenesulfonates, sodium alkylsulfates, dioctyl sulfosuccinate sodium salt, and poly-(alkylene glycol)s (e.g., polyoxyethylene nonyl phenyl ether).

The emulsified dispersion in the present invention is easily obtained by mixing an oil phase comprising the above described ingredients with an aqueous phase containing a protective colloid and a surfactant using known means for microemulsification, e.g., high-speed agitation or ultrasonic dispersion, to disperse the oil phase.

The proportion of the oil phase to the aqueous phase (weight of the oil phase/weight of the aqueous phase) is preferably from 0.02 to 0.6, more preferably from 0.1 to 0.4. If the proportion of the oil phase is below 0.02, the dispersion is too dilute to obtain sufficient color development. If the oil-phase proportion is above 0.6, the viscosity of the dispersion is too high. This results in handling difficulties and reduced stability of the coating liquid.

For coating a support with the thus-prepared liquid for forming a heat-sensitive layer, a known coating means for applying a water-based or organic-solvent-based coating liquid may be used. In this case, methyl cellulose, carboxymethyl cellulose, hydroxyethyl cellulose, a starch, gelatin, poly(vinyl alcohol), carboxylated poly(vinyl alcohol), polyacrylamide, polystyrene or a styrene copolymer, a polyester or an ester copolymer, polyethylene or an ethylene copolymer, an epoxy resin, an acrylate or methacrylate resin or an acrylate or methacrylate copolymer, a polyurethane resin, a polyamide resin, or the like may be used in this invention along with the microcapsules in order to safely and evenly apply the liquid for forming a heat-sensitive layer and to maintain the strength of the coating film.

A pigment, a wax, a hardener, and the like may be added to the heat-sensitive recording layer as needed. The heat-sensitive recording layer is preferably applied such that the total amount of the color former and the developer is from 0.1 to 10 g/m$^2$ and the thickness of the layer is from 1 to 20 μm.

The heat-sensitive recording material of the present invention may comprise a multilayer coating comprising two or more heat-sensitive recording layers having different recording sensitivities to obtain a desired heat-sensitive recording material (e.g., sensitive to different levels of thermal energy applied by a thermal head).

When a combination of a photo-decomposable diazo compound and a coupler is used, such recording layers described above each having a different color-developing property can be prepared, for example, by using bases each having a different basicity, or by using couplers each having a different coupling ability. In case of a combination of an electron-donating dye precursor and an electron-accepting compound, such recording layers can be prepared, for example, by using electron-donating dye precursors each having a different basicity, by using electron-accepting compounds each having a different acidity, or by using sensitizing agents each having a different melting point. In case of a combination of an organic metal salt and a reducing agent is used, such recording layers can be prepared, for example, by using reducing agents each having a different reducing ability, or by using auxiliary melting agents each having a different menting point.

In the present invention, a subbing layer is preferably formed on the support prior to forming the heat-sensitive recording layer containing microcapsules etc. and an anti-reflection layer. The subbing layer increases adhesion to thereby prevent the heat-sensitive layer and the anti-reflection layer from peeling off the support. For forming the subbing layer, an acrylic ester copolymer, poly(vinylidene chloride), SBR, a water-soluble polyester, or the like may be used. The thickness of the subbing layer is preferably from 0.1 to 0.5 μm. Two or more of the subbing layers may be formed on the support for enhancing adhesion.

When forming the heat-sensitive recording layer and anti-reflection layer on the subbing layer by coating with a coating liquid, the subbing layer may swell due to water contained in the coating liquid. This swelling may deteriorate images recorded on the heat-sensitive recording layer. It is therefore preferable to harden the subbing layer with a hardener. Examples of the hardener include dialdehydes such as glutaraldehyde, 2,3-dihydroxy-1,4-dioxane, etc. and boric acid, etc. These hardeners may be added in an amount suitable for the desired hardness, generally in the range of from 0.20 to 3.0% by weight based on the total amount of the subbing layer.

A protective layer is preferably formed on the heat-sensitive recording layer in the present invention in order to avoid light scattering on the heat-sensitive layer surface, which scattering may result, e.g., in a decrease in apparent transparency. This protective layer may be formed by a known method. Such protective layers are described in detail, e.g., in "Kami Pulp Gijutsu Times (Paper Pulp Technology Times)" (September 1985), pp. 2–4 and JP-A-63-318546.

To form a protective layer having satisfactory transparency, it is especially preferred to use wholly saponified poly(vinyl alcohol), carboxylated poly(vinyl alcohol), silica-modified poly(vinyl alcohol), or the like. The protective layer may contain a known hardener, a wax, a pigment, etc. Along with or in place of the conventional protective layer described above, a protective layer containing a silicone resin as a main component may be formed in the present invention. The silicone-based protective layer imparts good water resistance without impairing the transparency of the heat-sensitive recording layer.

The heat-sensitive recording layer, protective layer, anti-reflection layer, and subbing layer are formed by a known coating method, e.g., blade coating, air-knife coating, gravure coating, roll coating, spray coating, dip coating, or bar coating.

As described above, the heat-sensitive recording material of the present invention comprises a substantially transparent support and a heat-sensitive recording layer formed on one side of the support. The recording material is characterized in that the thermal recording energy required for increasing the transmission density of recorded areas as measured with a Macbeth transmission densitometer TD904 (visual filter) to a value higher by 0.1 than the transmission density of non-recorded areas is from 10 mJ/mm$^2$ to 40 mJ/mm$^2$, and that the energy required for obtaining a transmission density of 2.5 as measured with a Macbeth transmission densitometer TD904 (visual filter) is from 80 mJ/mm$^2$ to 130 mJ/mm$^2$. Consequently, the heat-sensitive recording material not only exhibits little unevenness in thermal-head recording caused by fluctuations in thermal-head resistivity, surface roughness of a glazing layer, etc., but also is stable to changes in environmental conditions including temperature and humidity. Thus, highly precise images such as medical images are stably obtained using the heat-sensitive recording material of the present invention and a conventional thermal head.

The present invention will be explained below in detail by reference to the following Examples, but the invention should not be construed as being limited to these Examples. Hereinafter, unless otherwise noted, all concentration values are given in terms of % by weight.

EXAMPLE 1

(Preparation of Microcapsule Dispersion A)

Into a mixed solvent containing 0.08 g of butanol and 3.6 g of ethyl acetate were dissolved a color former ingredient containing of 1.9 g of 2-anilino-3-methyl-6-N-ethyl-N-butylaminofluoran, 0.25 g of color former GN-2 (manufactured by Yamamoto Chemicals, Inc.), 0.36 g of color former GN-169 (manufactured by Yamamoto Chemicals, Inc.), 0.59 g of 1-methyl-3-methoxy-6-diethylaminofluoran, 0.2 g of Pergascript RED I-6B (manufactured by Ciba-Geigy Ltd.), and 0.08 g of Tinuvin P (manufactured by Ciba-Geigy Ltd.) and a capsule wall-forming material containing 0.4 g of a trimethylolpropane/xylylene diisocyanate adduct (isocyanate content, 11.6%; Takenate D-110N, trade name of Takeda Chemical Industries, Ltd.), 1.1 g of 1:2 by mol adduct of bisphenol A with xylylene diisocyanate, and 1.0 g of Sumidur N3200 (trade name for a capsule wall-forming agent manufactured by Sumitomo Chemical Co., Ltd.). The solution thus obtained was mixed with an aqueous phase prepared by mixing 7.5 g of an 8 wt % aqueous solution of poly(vinyl alcohol) (PVA 217C, manufactured by Kuraray Co., Ltd.) with 2.6 g of ion-exchanged water. This mixture was then emulsified with an Ace Homogenizer (manufactured by Nippon Seiki Co., Ltd.) at 10,000 rpm for 5 minutes. To the thus-obtained emulsion was added 1.55 g of a 4% aqueous tetraethylenepentamine solution. An encapsulation reaction was then conducted at 40° C. for 3 hours to prepare a capsule dispersion having an average particle diameter of 0.7 μm. All average particle diameters are given as a 50% volume-average particle diameter measured with a laser diffraction particle size distribution analyzer (manufactured by Horiba Ltd.).

(Preparation of Microcapsule Dispersion B)

Into a mixed solvent containing 0.08 g of butanol and 3.6 g of ethyl acetate were dissolved a color former ingredient containing 1.3 g of 2-anilino-3-methyl-6-N-ethyl-N-butylaminofluoran, 0.17 g of color former GN-2 (manufactured by Yamamoto Chemicals, Inc.), 0.25 g of color former GN-169 (manufactured by Yamamoto Chemicals, Inc.), 0.40 g of 1-methyl-3-methoxy-6-diethylaminofluoran, 0.14 g of Pergascript RED I-6B (manufactured by Ciba-Geigy Ltd.), and 0.05 g of Tinuvin P (manufactured by Ciba-Geigy Ltd.) and a capsule wall-forming material containing 4.00 g of a trimethylolpropane/xylylene diisocyanate adduct (isocyanate content, 12.5%; Takenate D-110NH, trade name of Takeda Chemical Industries, Ltd.). The solution thus obtained was mixed with an aqueous phase prepared by mixing 7.5 g of an 8 wt % aqueous solution of poly(vinyl alcohol) (PVA 217C, manufactured by Kuraray Co., Ltd.) with 2.6 g of ion-exchanged water. This mixture was then emulsified with an Ace Homogenizer (manufactured by Nippon Seiki Co., Ltd.) at 10,000 rpm for 5 minutes. To the thus-obtained emulsion was added 1.55 g of 4% aqueous tetraethylenepentamine solution. An encapsulation reaction was then conducted at 40° C. for 3 hours to prepare a capsule dispersion having an average particle diameter of 0.7 μm. All average particle diameters are given as a 50% volume-average particle diameter measured with a laser diffraction particle size distribution analyzer (manufactured by Horiba Ltd.).

(Preparation of Developer Emulsion A)

Into a mixed solvent containing 0.08 g of tricresyl phosphate, 0.04 g of diethyl maleate, and 1.5 g of ethyl acetate were dissolved 0.34 g of n-butyl bis(4-hydroxyphenyl)acetate, 0.83 g of the developer represented by structural formula (1):

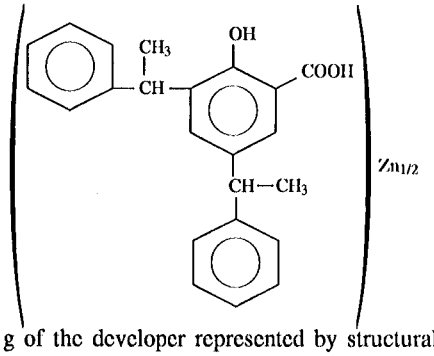

(1)

0.83 g of the developer represented by structural formula (2):

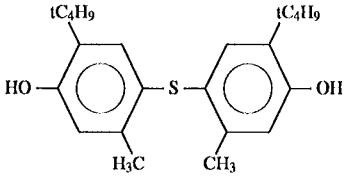

(2)

0.58 g of the developer represented by structural formula (3):

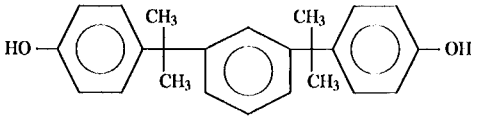

(3)

0.39 g of Sumilizer MDP-S (trade name of Sumitomo Chemical Co., Ltd.), and 0.35 g of Tinuvin 328 (trade name of Ciba-Geigy Ltd.). The solution thus obtained was mixed with an aqueous phase prepared by mixing 4.1 g of an 8 wt % aqueous solution of poly(vinyl alcohol) (PVA 217C, manufactured by Kuraray Co., Ltd.) with 8.2 g of ion-exchanged water, 0.9 g of a 2% aqueous solution of sodium (p-nonylbenzene butyl ether)sulfonate, and 0.9 g of a 2% aqueous solution of sodium dodecylsulfonate. This mixture was emulsified with an Ace Homogenizer (manufactured by Nippon Seiki Co., Ltd.) at 10,000 rpm to obtain an emulsion having an average particle diameter of 0.5 μm.

(Preparation of Developer Emulsion B)

Into a mixed solvent containing 0.08 g of tricresyl phosphate, 0.04 g of diethyl maleate, and 1.5 g of ethyl acetate were dissolved 0.93 g of the developer represented by structural formula (4):

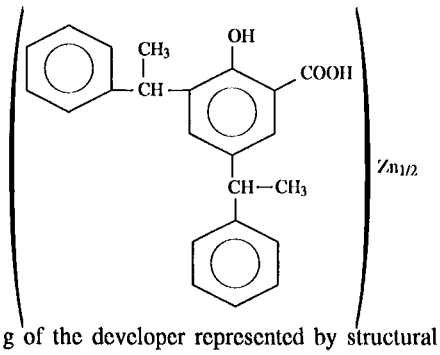

(4)

0.93 g of the developer represented by structural formula (5):

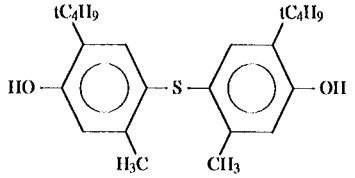

(5)

0.37 g of Sumilizer MDP-S (trade name of Sumitomo Chemical Co., Ltd.), 0.37 g of Sumilizer BBM-S (trade name of Sumitomo Chemical Co., Ltd.), 0.37 g of 1,1,3-tris(2-methyl-4-hydroxy-5-t-butylphenyl)butane, and 0.35 g of Tinuvin 328 (trade name of Ciba-Geigy Ltd.). The solution thus obtained was mixed with an aqueous phase prepared by mixing 4.1 g of an 8 wt % aqueous solution of poly(vinyl alcohol) (PVA 217C, manufactured by Kuraray Co., Ltd.) with 8.2 g of ion-exchanged water, 0.9 g of a 2% aqueous solution of sodium (p-nonylbenzene butyl ether-)sulfonate, and 0.9 g of a 2% aqueous solution of sodium dodecylsulfonate. This mixture was emulsified with an Ace Homogenizer (manufactured by Nippon Seiki Co., Ltd.) at 10,000 rpm to obtain an emulsion having an average particle diameter of 0.5 μm.

(Preparation of Protective-Layer Liquid)

(1) Preparation of Pigment Dispersion

To 99.0 g of water was added 24.8 g of kaolin (Kaogloss, manufactured by Mizusawa Industrial Chemicals, Ltd.). This mixture was stirred for 3 hours. To 99.3 g of this dispersion were added 4.6 g of a 40% dispersant (POIZ 532A, manufactured by Kao Corporation), 10 g of a 10% aqueous solution of poly(vinyl alcohol) (PVA 105, manufactured by Kuraray Co., Ltd.), 10.4 g of a 30 wt % zinc stearate dispersion (Z-7-30, manufactured by Chukyo Yushi Co., Ltd.), 0.6 g of a 10% aqueous solution of sodium dodecylbenzenesulfonate, and 6.8 g of water. This mixture was treated with a ball mill to disperse the kaolin to an average particle diameter of 0.8 μm.

(2) Preparation of Protective-Layer Liquid

The kaolin dispersion described above was added in an amount of 28.2 g to a mixture of 51.3 g of water, 407.7 g of a 6 wt % aqueous solution of poly(vinyl alcohol) (PVA 124C, manufactured by Kuraray Co., Ltd.), 0.42 g of a 20.5 wt % zinc stearate dispersion (F155, manufactured by Chukyo Yushi Co., Ltd.), and 21.4 g of 1.14% aqueous boric acid solution. This mixture was mixed with 3.11 g of a 30 wt % dispersion of a wax (paraffin wax having a melting point of 68° C.; average particle diameter, 0.25 μm), 4.5 g of a 4% aqueous fluoropolymer dispersion (ME413 manufactured by Daikin Industries, Ltd.), 10.5 g of a 10% aqueous solution of sodium dodecylbenzenesulfonate, 16.7 g of a 2 wt % aqueous solution of the compound represented by structural formula (6):

$$C_8F_{17}SO_2N(C_3H_7)CH_2COOK \quad (6)$$

and 0.9 g of 40% aqueous glyoxal solution. Thus, a protective-layer liquid was obtained.

(Preparation of Capsules for Ultraviolet Filter Layer)

To 8.18 g of ethyl acetate were added 1.58 g of Tinuvin PS (trade name of Ciba-Geigy Ltd.), 6.28 g of Tinuvin 328 (trade name of Ciba-Geigy Ltd.), 5.22 g of Tinuvin 343 (trade name of Ciba-Geigy Ltd.), 1.44 g of the compound represented by structural formula (7):

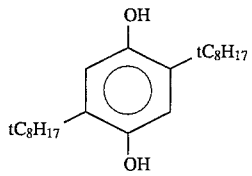

(7)

and 7.28 g of the compound represented by the following structural formula (8)

$$O{=}P{-}(OCH_2CH_2CH(CH_3)CH_2C(CH_3)_2CH_3)_3 \quad (8)$$

This mixture was heated to 70° C. to obtain a solution, which was then cooled to 35° C. Thereto were added 0.9 g of Takenate D110N (trade name for a capsule wall-forming agent manufactured by Takeda Chemical Industries, Ltd.) and 0.3 g of Burhock D750 (trade name of a capsule wall-forming agent manufactured by Dainippon Ink & Chemicals, Inc.) as capsule wall-forming agents. This mixture was warmed at 35° C. for 40 minutes. The solution thus obtained was mixed with an aqueous phase obtained by mixing 116.3 g of a 15 wt % aqueous solution of poly(vinyl alcohol) (PVA 205, manufactured by Kuraray Co., Ltd.) with 8.0 g of a 10 wt % aqueous solution of sodium dodecylbenzenesulfonate. This mixture was emulsified with an Ace Homogenizer (manufactured by Nippon Seiki Co., Ltd.) at 15,000 rpm for 15 minutes to obtain an emulsion having a 50% volume-average particle diameter of 0.25 μm. To the thus-obtained emulsion were added 58 g of water and 0.15 g of tetraethylenepentamine. An encapsulation reaction was then conducted at 40° C. for 3 hours to prepare a capsule dispersion having an average particle diameter of 0.25 μm.

(Preparation of Coating Liquid for Ultraviolet Filter Layer)

To a mixture of 42.31 g of water and 42.0 g of a 9.54 wt % aqueous solution of silanol-modified poly(vinyl alcohol) (R2105, manufactured by Kuraray Co., Ltd.) was added 13.36 g of the above-described capsule dispersion for an ultraviolet filter layer (solid content, 24.15%). This mixture was mixed with 16.87 g of a 50 wt % aqueous solution of the compound represented by structural formula (9):

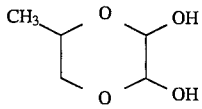

(9)

and 65.3 g of 20% colloidal silica (Snowtex O, manufactured by Nissan Chemical Industries, Ltd.). Thus, a coating liquid for ultraviolet filter layer was prepared.

(Preparation of Anti-reflection Layer Liquid)

To 47.82 g of water was added 0.105 g of rice starch having an average particle diameter of 5 μm (manufactured by Matsutani Kagaku Kogyo Co., Ltd.). After the starch was sufficiently dispersed, this mixture was mixed with 2.5 g of a 2 wt % aqueous solution of di(2-ethyl)hexyl sulfosuccinate, 1.66 g of a 2 wt % aqueous solution of the compound represented by structural formula (10):

$$O{=}P{-}(OCH_2CH_2CH(CH_3)CH_2C(CH_3)_2CH_3)_3 \quad (10)$$

and 16.67 g of 20% colloidal silica (Snowtex O, manufactured by Nissan Chemical Industries, Ltd.). Thus, a coating liquid for anti-reflection layer was prepared.

(Production of Transparent Support)

A 175 μm-thick poly(ethylene terephthalate) (PET) film, which support had been colored blue as defined by x=0.2850 and y=0.2995 in the chromaticity coordinate system described in JIS-Z8701, was coated on one side thereof with a SBR latex in an amount of 0.32 g/m$^2$ on a dry basis. A coating liquid prepared by mixing 20 g of a 5 wt % aqueous solution of gelatin (Nitta Gelatin #810) with 0.048 g of polymethylmethacrylamide particles having a particle diameter of 2.2 μm, 0.12 g of 3 wt % aqueous 1,2-benzothiazolin-3-one solution, and 1.01 g of a 2 wt % aqueous solution of di(2-ethyl)hexyl sulfosuccinate was applied to the SBR-coated surface in an amount of 0.09 g/m$^2$ on a dry basis. The other side of the film was then coated in the same manner to prepare a transparent support having a subbing layer on both side thereof.

(Production of Heat-Sensitive Recording Material)

The coating liquid for an ultraviolet filter layer described above was applied onto one of the subbing layers of the above transparent support in an amount of 1.8 g/m$^2$ on a dry basis, and dried. Subsequently, the coating liquid for a anti-reflection layer described above was applied to the thus-formed ultraviolet filter layer in an amount of 2.2 g/m$^2$ on a dry basis, and dried. A coating liquid prepared by mixing 16.3 g of microcapsule dispersion A described above (solid content, 20.9%) with 25.2 g of microcapsule dispersion B described above (solid content, 30.7%), 114.4 g of developer emulsion B described above (solid content, 21.0%), 1.8 g of a 50 wt % aqueous solution of the compound represented by structural formula (11):

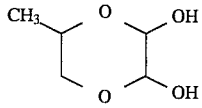

(11)

240 g of a 15 w % aqueous solution of poly(vinyl alcohol) (PVA 205C, manufactured by Kuraray Co., Ltd.), and 24 g of Snowtex O (colloidal silica manufactured by Nissan Chemical Industries, Ltd.) was then applied to the support on the side opposite the ultraviolet filter layer and the anti-reflection layer in an amount of 8.96 g/m$^2$ on a dry basis, and dried. On the other hand, 8.92 g of a coating liquid prepared by mixing 8.8 g of capsule dispersion A described above (solid content, 20.9%) with 0.3 g of a 50 wt % aqueous solution of the compound represented by structural formula (12):

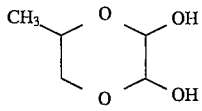

(12)

was mixed with 18.6 g of a coating liquid prepared by mixing 28.2 g of developer emulsion A described above (solid content, 21.3%) with 0.18 g of 40 wt % aqueous glyoxal solution and 0.18 g of water, and further mixed with 1.8 g of Snowtex O (colloidal silica manufactured by Nissan Chemical Industries, Ltd.). This mixture was immediately applied onto the microcapsule-containing layer in an amount of 5.97 g/m$^2$ on a dry basis, and dried. Subsequently, the coating liquid for a protective layer described above was applied to the thus-formed coating film in an amount of 2.5 g/m$^2$ on a dry basis, and dried. Thus, a heat-sensitive recording material according to the present invention was obtained.

EXAMPLE 2

(Preparation of Microcapsule Dispersion C)

To 5 g of the diazonium compound represented by structural formula (13):

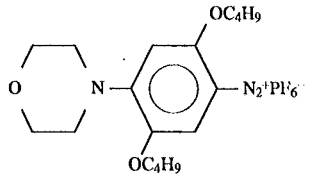

(13)

were added 15 g of methylene chloride, 5 g of tricresyl phosphate, 15 g of trimethylolpropane trimethacrylate, and 20 g of a 75 wt % ethyl acetate solution of a 3:1 adduct of m-xylylene diisocyanate with trimethylolpropane (Takenate D 110N, manufactured by Takeda Chemical Industries, Ltd.). This mixture was stirred to produce a homogeneous oil phase solution.

The oil phase solution thus obtained was mixed with an aqueous phase containing 60 g of a 7 wt % aqueous solution of poly(vinyl alcohol) (PVA 217E, manufactured by Kuraray Co., Ltd.), and this mixture was emulsified with an Ace Homogenizer (manufactured by Nippon Seiki Co., Ltd.) at 8,000 rpm for 5 minutes. To the thus-obtained emulsion was added 50 g of water. An encapsulation reaction was then conducted at 40° C. for 3 hours to prepare a capsule dispersion having an average particle diameter of 1.5 μm. After the encapsulation reaction, 10 ml of an ion-exchange resin (MB-3, manufactured by Japan Organo Co., Ltd.) was added to this dispersion. This mixture was stirred for 30 minutes and then filtered to obtain microcapsule dispersion C.

(Preparation of Microcapsule Dispersion D)

To 5 g of the diazonium compound represented by structural formula (14):

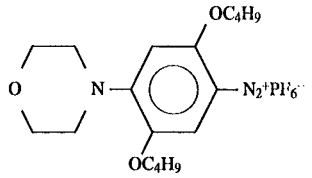

(14)

were added 15 g of methylene chloride, 5 g of tricresyl phosphate, 15 g of trimethylolpropane trimethacrylate, and 20 g of a 75 wt % ethyl acetate solution of a 3:1 adduct of tolylene diisocyanate with trimethylolpropane (Burnock D750, manufactured by Dainippon Ink & Chemicals, Inc.). This mixture was stirred to produce a homogeneous oil phase solution.

The oil phase solution thus obtained was mixed with an aqueous phase containing 60 g of a 7 wt % aqueous solution of poly(vinyl alcohol) (PVA 217E, manufactured by Kuraray Co., Ltd.), and this mixture was emulsified with an Ace Homogenizer (manufactured by Nippon Seiki Co., Ltd.) at 8,000 rpm for 5 minutes. To the thus-obtained emulsion was added 50 g of water. An encapsulation reaction was then conducted at 40° C. for 3 hours to prepare a capsule dispersion having an average particle diameter of 1.5 μm. To this dispersion was added 10 ml of an ion-exchange resin (MB-3, manufactured by Japan Organo Co., Ltd.). This mixture was stirred for 30 minutes and then filtered to obtain microcapsule dispersion D.

Into 25 g of ethyl acetate were dissolved 4.3 g of the coupler compound represented by structural formula (15):

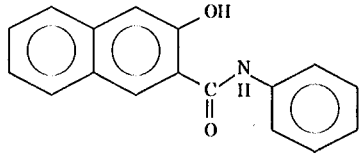

(15)

0.7 g of the coupler compound represented by structural formula (16):

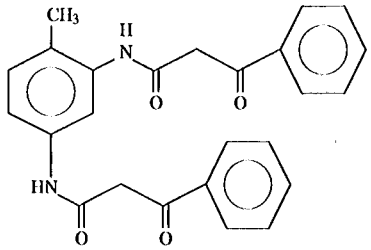

(16)

5 g of 1,2,3-triphenylguanidine, 0.8 g of tricresyl phosphate, and 0.2 g of diethyl maleate. The solution thus obtained was mixed with an aqueous phase prepared by mixing 40 g of an 8 wt % aqueous poly(vinyl alcohol) solution with 15 g of water and 0.5 g of sodium dodecylbenzenesulfonate. This mixture was emulsified with an Ace Homogenizer (manufactured by Nippon Seiki Co., Ltd.) at 10,000 rpm to obtain an emulsion having an average particle diameter of 0.5 μm.

(Production of Heat-Sensitive Recording Material)

Ten grams of the coupler emulsion was mixed with 2.5 g each of microcapsule dispersions C and D described above each containing a diazonium compound. This mixture was applied to the same poly(ethylene terephthalate) (PET) support having subbing layers on each side thereof as in Example 1, in an amount of 15 g/m$^2$ on a dry basis. The coating was dried to form a heat-sensitive recording layer. The same protective-layer liquid as in Example 1 was then applied to the thus-formed heat-sensitive recording layer at a thickness of 2 μm on a dry basis, and dried to produce a transparent heat-sensitive recording material. Thereafter, the same anti-reflection layer liquid as in Example 1 was applied to the heat-sensitive recording material on the side opposite to the heat-sensitive layer in an amount of 1.0 g/m$^2$ on a dry basis, and dried to form an anti-reflection layer. Thus, a transparent heat-sensitive recording material according to the present invention was produced.

COMPARATIVE EXAMPLE 1

A heat-sensitive recording material was obtained in the same manner as in Example 1, except that a heat-sensitive recording layer was formed as follows.

Three separate dispersions were, respectively, prepared by adding to 150 g of a 5% aqueous solution of poly(vinyl alcohol) (Kuraray PVA-105) each of 30 g 2-anilino- 3-methyl-6-N-dibutylaminofluoran as a color former, 30 g of bisphenol A as a developer, and 30 g of β-naphthyl benzyl ether as a sensitizer. Each of these mixtures were treated with a Dynomill (Type: KDL; manufactured by Shinmaru Enterprises Corp.) along with 230 cc of glass beads having a particle diameter of 0.8 mm, until each of the color former, developer, and sensitizer was dispersed to an average particle diameter of 0.5 μm. The particle diameter of each dispersion is given as a 50% volume-average particle diameter measured with a laser diffraction particle size distribution analyzer (LA-500, manufactured by Horiba Ltd.). The color former dispersion, developer dispersion, and sensitizer dispersion thus prepared were mixed together in a proportion of 5:10:10 by weight. To this mixture was added a 10% aqueous solution of poly(vinyl alcohol) (Kuraray PVA-105) in an amount of 40% by weight on a dry basis based on the total amount of all solid ingredients. Thus, a coating liquid was obtained.

The same transparent support as in Example 1, on which the ultraviolet filter layer and anti-reflection layer had been formed, was coated with the above-described coating liquid with a wire-wound bar in an amount of 15 g/m$^2$ on a dry basis, and the coating was dried to form a heat-sensitive recording layer. The protective-layer liquid obtained in Example 1 was then applied to the thus-formed heat-sensitive recording layer at a thickness of 2 μm on a dry basis, and dried to produce a heat-sensitive recording material.

COMPARATIVE EXAMPLE 2

A heat-sensitive recording material was obtained in the same manner as in Example 1, except that a heat-sensitive recording layer was formed as follows.

A coating liquid prepared by mixing 45.3 g of microcapsule dispersion A (solid content, 20.9%) with 114.4 g of developer emulsion A described above (solid content, 21.3%), 1.8 g of a 50 wt % aqueous solution of the compound represented by structural formula (17):

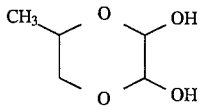

(17)

80 g of a 15 wt % aqueous solution of poly(vinyl alcohol) (PVA 205C, manufactured by Kuraray Co., Ltd.), and 24 g of Snowtex O (colloidal silica manufactured by Nissan Chemical Industries, Ltd.) was applied in an amount of 15.0 g/m$^2$ on a dry basis, and dried. The coating liquid for a protective layer obtained in Example 1 was then applied to the thus-formed coating film in an amount of 2.5 g/m$^2$ on a dry basis, and dried to obtain a heat-sensitive recording material.

COMPARATIVE EXAMPLE 3

A heat-sensitive recording material was obtained in the same manner as in Example 1, except that a heat-sensitive recording layer was formed as follows.

A coating liquid prepared by mixing 45.3 g of microcapsule dispersion A (solid content, 20.9%) with 114.4 g of developer emulsion A described above (solid content, 21.3%), 1.8 g of a 50 wt % aqueous solution of the compound represented by structural formula (18):

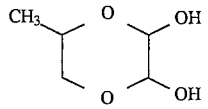

(18)

480 g of a 15 wt % aqueous solution of poly(vinyl alcohol) (PVA 205C, manufactured by Kuraray Co., Ltd.), and 24 g of Snowtex O (colloidal silica manufactured by Nissan Chemical Industries, Ltd.) was applied in an amount of 15.0 g/m$^2$ on a dry basis, and dried. The coating liquid for a protective layer obtained in Example 1 was then applied to the thus-formed coating film in an amount of 2.5 g/m$^2$ on a dry basis, and dried to obtain a heat-sensitive recording material.

The heat-sensitive recording materials obtained above were used for recording with a thermal printer (FTI-1000, manufactured by Fuji Photo Film Co., Ltd.) under conditions of 30° C., 90% RH and 10° C., 20% RH while changing the recording energy from 1 mJ/mm$^2$ to 140 mJ/mm$^2$ to compare the gradation properties of the recording materials. A CT image was further printed on the heat-sensitive recording materials to compare the image qualities of these materials.

The results obtained are shown in Table 1.

TABLE 1

| | Environmental conditions | Example 1 | Example 2 | Comparative Example 1 | Comparative Example 2 | Comparative Example 3 |
|---|---|---|---|---|---|---|
| Energy A[1)] (mJ/mm$^2$) | 10° C., 20% RH | 35 | 35 | 18 | 31 | 51 |
| | 30° C., 90% RH | 28 | 27 | 11 | 21 | 42 |
| Energy B[2)] (mJ/mm$^2$) | 10° C., 20% RH | 127 | 101 | 52 | 62 | 91 |
| | 30° C., 90% RH | 114 | 87 | 45 | 52 | 83 |
| Density difference[3)] | — | 0.29 | 0.34 | 0.89 | —[4)] | 0.68 |
| Unevenness of CT image[5)] | — | G | G | U | U | N |

Remarks:
[1)]Energy A is the energy required for increasing the transmission density of recorded areas to a value higher by 0.1 than the transmission density of non-recorded areas.
[2)]Energy B is the energy required for obtaining a transmission density of 2.5 in recorded areas.
[3)]Density difference means the difference in density at an energy of 60 mJ/mm$^2$ between 10° C., 20% RH and 30° C., 90% RH.
[4)]No density difference was observed because the saturation density had been reached.
[5)]Unevenness of CT image was evaluated in accordance with the following criteria:
G: good
N: slightly noticeable
U: unsuitable for practical use The above results show that the heat-sensitive recording material of the present invention provides highly precise images, e.g., medical images, in a stable manner using a conventional thermal head under various environmental conditions.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a substantially transparent support and a heat-sensitive recording layer formed on one side of the support, said recording material being adapted for thermal recording comprising imagewise applying thermal energy to the recording layer to obtain recorded areas and non-recorded areas of the recording material, wherein the thermal recording energy required for increasing the transmission density of recorded areas as measured with a Macbeth transmission densitometer TD904 (visual filter) to a value higher by 0.1 than the transmission density of non-recorded areas is from 10 $mJ/mm^2$ to 40 $mJ/mm^2$, and the energy required for obtaining a transmission density of 2.5 in recorded areas as measured with a Macbeth transmission densitometer TD904 (visual filter) is from 80 $mJ/mm^2$ to 130 $mJ/mm^2$.

2. The heat-sensitive recording material as claimed in claim 1, wherein said substantially transparent support comprises a polyester resin.

3. The heat-sensitive recording material as claimed in claim 1, wherein said heat-sensitive recording layer comprises a color former and a developer, and the addition amount of the developer is from 50 to 800% by weight based on the amount of the color former.

* * * * *